US005203405A

United States Patent [19]

Gentry et al.

[11] Patent Number: 5,203,405

[45] Date of Patent: Apr. 20, 1993

[54] TWO PASS SHELL AND TUBE HEAT EXCHANGER WITH RETURN ANNULAR DISTRIBUTOR

[75] Inventors: Cecil C. Gentry; Irvin M. Atkins, Jr., both of Bartlesville, Okla.

[73] Assignee: Phillips Petroleum Company, Bartlesville, Okla.

[21] Appl. No.: 829,191

[22] Filed: Feb. 3, 1992

[51] Int. Cl.[5] ..... F28D 7/06

[52] U.S. Cl. ..... 165/160; 165/161

[58] Field of Search ..... 165/160, 161

[56] References Cited

U.S. PATENT DOCUMENTS

| | | | |
|---|---|---|---|
| 2,058,324 | 10/1936 | Kuhner | 165/161 |
| 2,655,350 | 10/1953 | Gaylord, Jr. | 165/160 |
| 2,900,173 | 8/1959 | Pickford | 165/161 |
| 2,919,903 | 1/1960 | Vautrain | 257/32 |
| 3,566,961 | 3/1971 | Lorenz et al. | 165/160 |
| 3,732,922 | 5/1973 | Pouderoux | 165/160 |
| 3,822,741 | 7/1974 | Lippitsch | 165/158 |
| 3,871,445 | 3/1975 | Wanka et al. | 165/161 |
| 4,635,707 | 1/1987 | Gentry | 165/1 |
| 4,991,648 | 2/1991 | Magari et al. | 165/161 |

FOREIGN PATENT DOCUMENTS

| | | | |
|---|---|---|---|
| 194294 | 10/1985 | Japan | 165/161 |

OTHER PUBLICATIONS

Robert H. Perry and Cecil H. Chilton, Chemical Engineer's Handbook, 5th Ed. (1973) pp. 11-4 to 11-7.

*Primary Examiner*—John Rivell
*Assistant Examiner*—L. R. Leo
*Attorney, Agent, or Firm*—David L. Kinsinger

[57] ABSTRACT

A shell unit for use in a two pass shell and tube heat exchanger is provided. The shell unit has a return distributor means for providing direct fluid flow communication between the first pass of the two pass shell and tube heat exchanger and the second pass of the two pass shell and tube heat exchanger without excessive flow obstructions and associated pressure losses.

10 Claims, 3 Drawing Sheets

TWO PASS SHELL AND TUBE HEAT EXCHANGER WITH RETURN ANNULAR DISTRIBUTOR

BACKGROUND OF THE INVENTION

This invention relates to shell and tube heat exchangers. More specifically, this invention relates to a two-pass shell and tube heat exchanger with a U-tube bundle.

Shell and tube heat exchangers have long been known as useful tools for heating fluids and using thermal energy. Such shell and tube heat exchangers have been developed to a significant degree of sophistication. These heat exchangers comprise a shell surrounding a tube bundle usually attached to a tube sheet. Fluid flowing through the shell is subjected to indirect heat exchange with another fluid flowing through the tubes.

Because of their low shell side, pressure loss characteristics, heat exchangers having two shell side-fluid passes are increasingly being used in gas services and as feedwater heaters. Two shell-pass arrangements, containing a longitudinal plate along the shell axis, are also used to produce pure counterflow and to avoid temperature crosses, which may occur in conventional, single shell-pass arrangements. The most common tube bundle configuration for a two shell-pass geometry is a U-tube bundle. In a two shell-pass arrangement, an axial plate is installed inside the shell of a shell and tube heat exchanger to form a longitudinal baffle. This longitudinal baffle produces two distinct shell side flow passages, i.e., an inlet and an exit passage. In such a configuration, fluid enters the shell through a single nozzle at the tube sheet end of the exchangers, flows axially through the shell side inlet passage, experiences a 180° flow reversal at the end of the longitudinal baffle, and flows axially back to the exit nozzle through the exit shell side flow passage. In a U-tube bundle, this flow reversal occurs in the U-bend region of the tube bundle, where U-bend supports are normally required for tube vibration protection. In such an arrangement, these supports of the U-bend region can create excessive flow obstructions and pressure losses. If, however, U-bend supports are not utilized in the U-bend region, fluid flow through the U-bend region can create flow-induced vibration in the tube bundle.

An important object of the present invention is to provide a two pass shell and tube heat exchanger having a U-tube bundle in which the U-bend region may be properly supported, while eliminating excessive flow obstructions and associated pressure losses and with reduced tendency for flow-induced vibration in the U-bend region.

Another object of this invention is to provide a two pass shell and tube heat exchanger having a U-tube bundle in which the tendency for flow-induced vibration in the U-bend region will be reduced.

Another object of this invention is to provide a shell unit for use in a two pass shell and tube heat exchanger having a U-tube bundle which will allow fluid flow through the shell unit without excessive flow obstructions and associated pressure losses.

Other and further objects, aims, purposes, features, advantages, embodiments, and the like will be apparent to those skilled in the art from the present specification, taken with the associated drawings, and the appended claims.

Summary of the Invention

More particularly, in one aspect, the present invention relates to a two pass shell and tube heat exchanger having a shell with a longitudinal baffle that separates the shell into a bottom half and a top half, and having a tube bundle having a first pass and a second pass of tubes and a U-bend tube portion for innerconnecting the first and second passes of tubes. According to the present invention, a shell suitable for use in such a shell and tube heat exchanger is provided, having an inner surface and at least one annular return distributor attached to said shell, with at least one shell port which provides communication for the inner surface of the bottom half of the shell with the annulus of the annular return distributor, and at least one shell port which provides communication for the annulus with the inner surface of the top half of the shell so as to provide direct fluid flow communication between the bottom half of the shell and the top half of the shell without the necessity for fluid flow through the U-bend tube portion of the shell.

The materials utilized in the heat exchanger of this invention are standard materials and comprise carbon steel as an example for the shell and alloy steels for the tube sheet.

In the drawings, further preferred embodiments and details of this invention are shown. These drawings should, however, not be interpreted to unduly limit the scope of this invention.

DETAILED DESCRIPTION OF THE INVENTION

Figure 1:
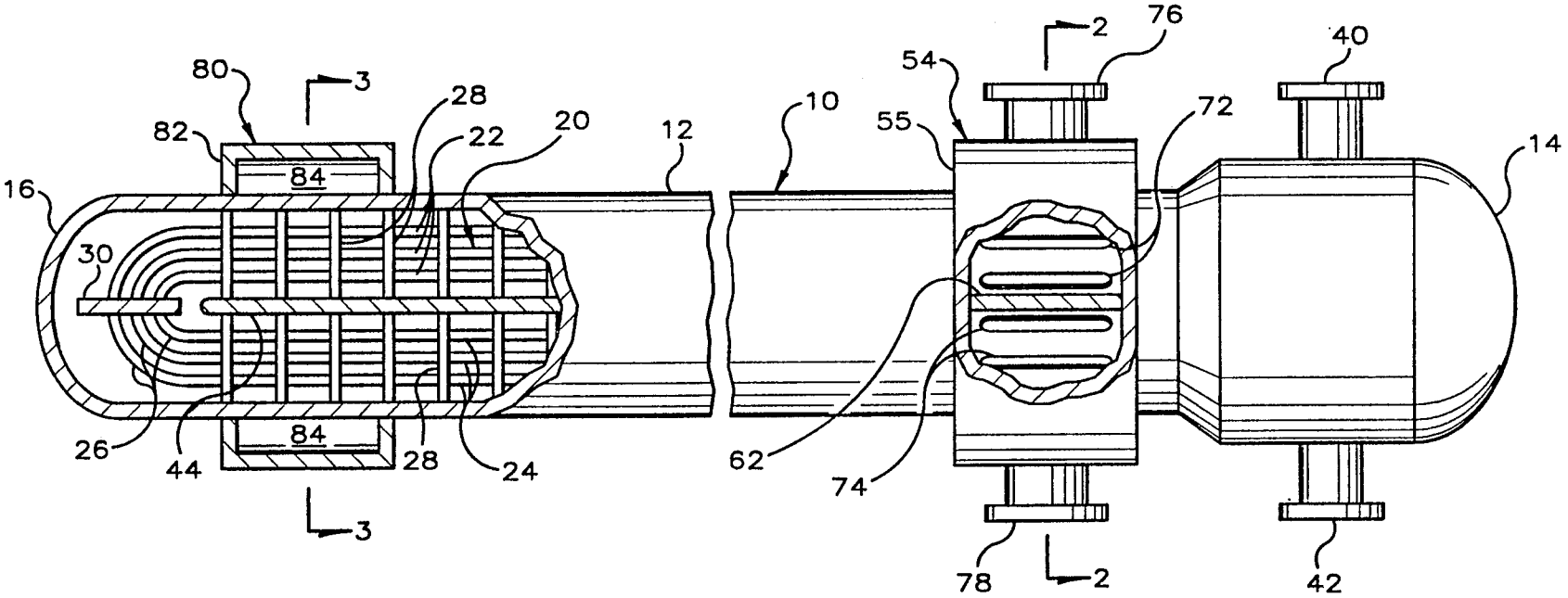
FIG. 1 is a front elevation view of a shell and tube heat exchanger in accordance with this invention with portions thereof broken away in order to more clearly illustrate the present invention.

Referring to FIG. 1, there is seen an elevation view of one embodiment of a shell and tube heat exchanger in accordance with the present invention which is herein designated in its entirety by the numeral 10. Heat exchanger 10 includes an elongated, substantially cylindrical housing or shell 12 with a first hemispherical end 14 and a second hemispherical end 16.

Positioned within the shell 12 is a U-shaped tube bundle, generally designated by the numeral 20. Tube bundle 20 includes a plurality of tubes with a first pass of substantially longitudinal tubes or tube portions 22 and a second pass of substantially longitudinal tubes or tube portions 24. First pass 22 and second pass 24 are parallel to a longitudinal axis of tube bundle 20. A plurality of U-bend tubes or tube portions 26 innerconnect corresponding tubes or tube portions in the first pass 22 and the second pass 24. Each tube formed by first pass 22, second pass 24 and U-bend tube 26 may be integrally formed or fabricated from separate elements. Either U-tube construction is known in the art.

Preferably, a tube support 28, such as disclosed in U.S. Pat. No. 4,429,739 to Gentry et al, provides a supporting means for first tube pass 22 and second tube pass 24. Preferably, a U-bend tube support 30, such as disclosed in U.S. Pat. No. 5,005,637 to Gentry, provides a supporting means for U-bend tubes 26. While the disclosed tube supports are presently preferred, other types of tube support, such as plate baffles, are also acceptable for utilization in the present invention.

Figure 4:
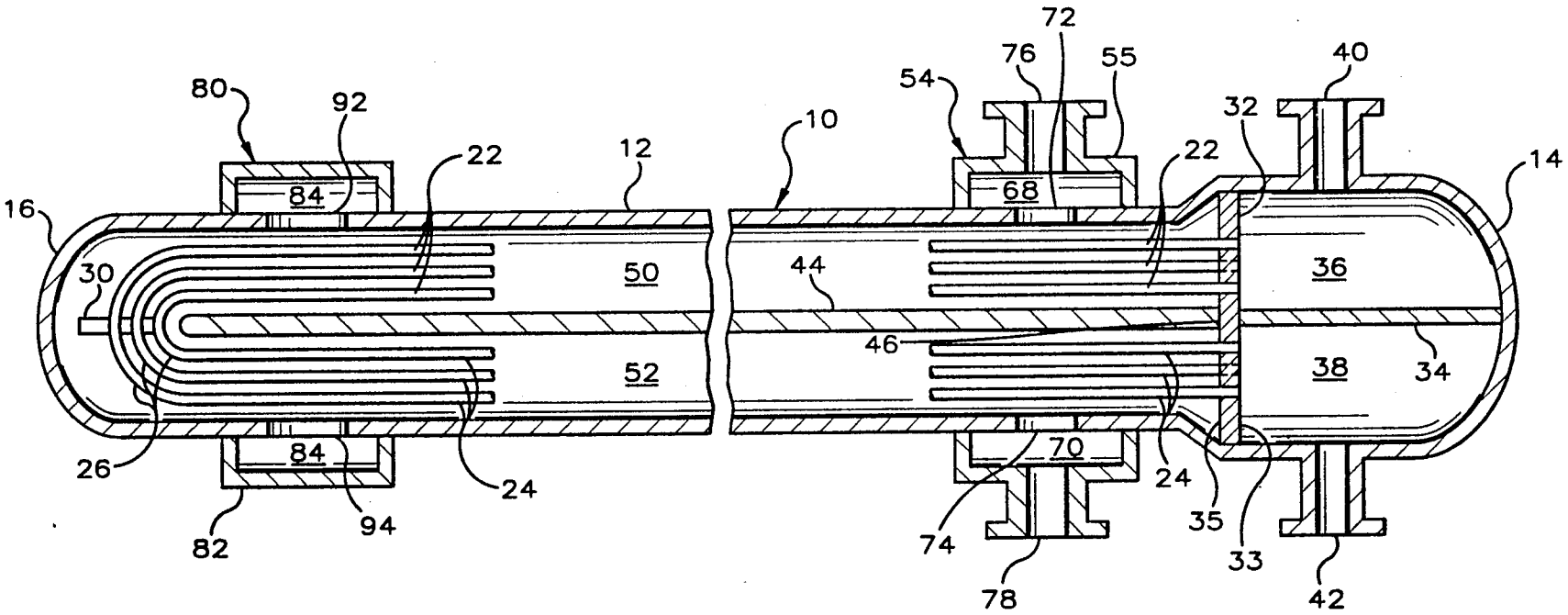
FIG. 4 is a longitudinal cross-section view taken along line 4—4 of FIG. 2 with portions of the tube bundle broken away in order to more clearly illustrate the present invention.

Referring now to FIG. 4, a cross-sectional view of heat exchanger 10 is shown with a portion of the U-shaped tube bundle 20 removed in order to more clearly illustrate the present invention. A tube sheet or plate 32 is disposed transversely within the shell 12. The tube sheet 32 has a first face 33 and a second face 35. A pass partition 34 extends between the first end 14 of the shell 12 and the tube sheet 32, so that the combination of the pass partition 34, the first face 33 of the tube sheet 32 and the inner surface of the shell 12 create an inlet chamber 36 and an outlet chamber 38. A tube inlet 40 provides communication with inlet chamber 36 and a tube outlet 42 is provided in communication with outlet chamber 38.

The plurality of tubes of the first pass 22 extend through the tube sheet 32 so as to be in fluid flow communication with the inlet chamber 36. The plurality of tubes of the second pass 24 extend through the tube sheet 32 so as to be in fluid flow communication with the outlet chamber 38. Thereby, fluid flow communication is provided between the inlet chamber 36 and the outlet chamber 38 by way of the plurality of tubes comprising the first pass 22, second pass 24 and U-bend tubes 26.

A longitudinal baffle 44 is positioned between the tube sheet 32 and the second end 16 of the shell 12. The longitudinal baffle 44 has a first end 46 that is sealingly engaged with the second face 35 of the tube sheet 32, and the longitudinal baffle 44 has a second end 48 that is positioned between the tube sheet 32 and the second end 16 of the shell 12 so as to allow an opening between the second end 48 of the longitudinal baffle 44 and the inner surface of the second end 16 of the shell 12. The sides of the longitudinal baffle 44 are sealingly engaged with the inner wall of the shell 12 so as the divide the shell 12 into an upper chamber 50 and a lower chamber 52.

The opening between the second end 48 of the longitudinal baffle 44 and the inner surface of the second end 16 of the shell 12 provides passage by which the U-bend tubes 26 pass from the upper chamber 50 to the lower chamber 52. The U-bend tube support 30 is positioned within the opening between the second end 48 of the longitudinal baffle 44 and the second end 16 of the shell 12. Additionally, fluid flow communication is provided between the upper chamber 50 and the lower chamber 52 by way of the opening between the second end 48 of the longitudinal baffle 44 and the second end 16 of the shell 12, although this fluid flow is somewhat restricted by the U-bend tubes 26 and the U-bend tube support 30.

Figure 2:
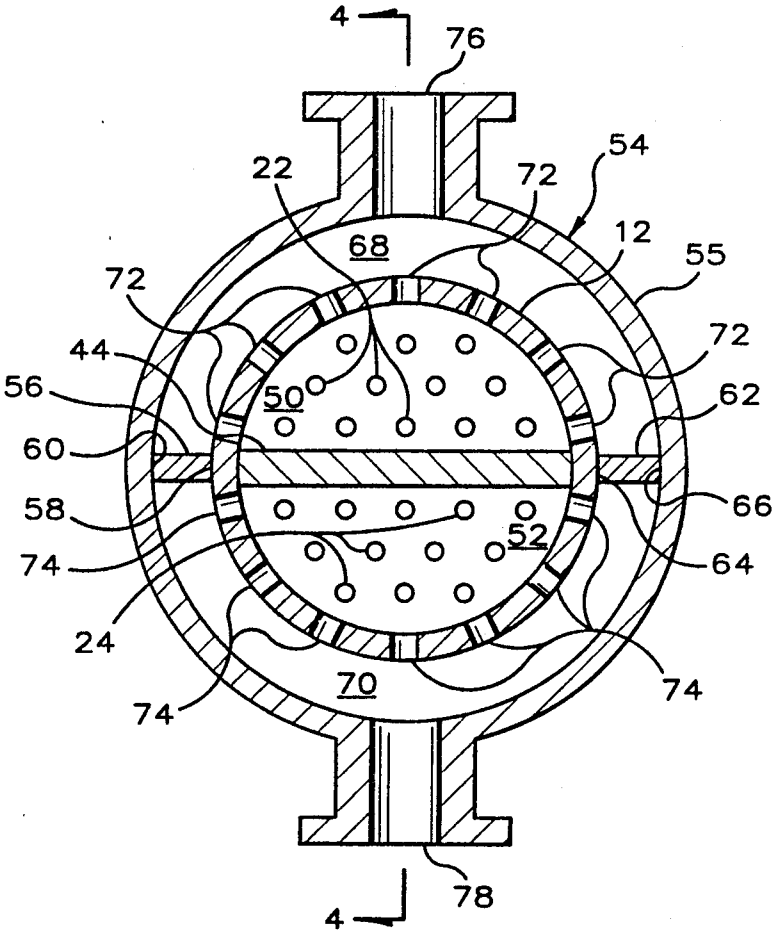
FIG. 2 is an enlarged cross-section view taken along line 2—2 of FIG. 1.

Referring to FIGS. 2 and 4, an annular distributor is shown and generally designated by the numeral 54. The annular distributor 54 is provided in order to allow even flow of fluid material into the upper chamber 50 and away from the lower chamber 52. The annular distributor 54 comprises an annular distributor shell or housing 55 which circumscribes the outer surface of the heat exchanger shell 12 so as to define an annular space between the outer surface of the heat exchanger shell 12 and the distributor shell 55. The distributor shell 55 is positioned so as to circumscribe a portion of the heat exchanger shell 12 between the tube sheet 32 and the second end 48 of the longitudinal baffle 44. Preferably, the distributor shell 55 is positioned in close proximity to the tube sheet 32.

A first distributor partition 56 is positioned within the annular space between the outer surface of the shell 12 and the inner surface of the distributor shell 55, having a first end 58 sealingly engaged to the outer surface of the shell 12 and a second end 60 sealingly engaged with the inner surface of the distributor shell 55. A second distributor partition 62 is positioned within the annular space between the inner surface of the shell 12 and the outer surface of the distributor shell 55 along the opposite side of the surface of the shell 12 from the first distributor partition 56. The second distributor partition has a first end 64 sealingly engaged with the outer surface of the shell 12 and a second end 66 sealingly engaged with the inner surface of the distributor shell 55.

The combination of the first distributor partition 56 and the second distributor partition 62 divide the annular space between the outer surface of the shell 12 and the inner surface of the distributor shell 55 into an upper annular chamber 68 and a lower annular chamber 70. At least one first upper slot-like opening or port 72 is provided in the shell 12 so as to provide direct fluid flow communication between the upper annular chamber 68 and the upper chamber 50. Preferably, a plurality of first upper slot-like openings 72 are provided so that each first upper slot-like opening 72 provides direct fluid flow communication between the upper annular chamber 68 and the upper chamber 50. At least one first lower slot-like opening or port 74 is provided in the shell 12 so as to provide direct fluid flow communication between the lower annular chamber 70 and the lower chamber 52. Preferably, a plurality of first lower slot-like openings 74 are provided in the shell 12, so that each first lower slot-like opening 74 provides direct fluid flow communication between the lower annular chamber 70 and the lower chamber 52. A shell inlet 76 provides communication with the upper annular chamber 68 and a shell outlet 78 is provided in communication with the lower annular chamber 70.

Figure 3:
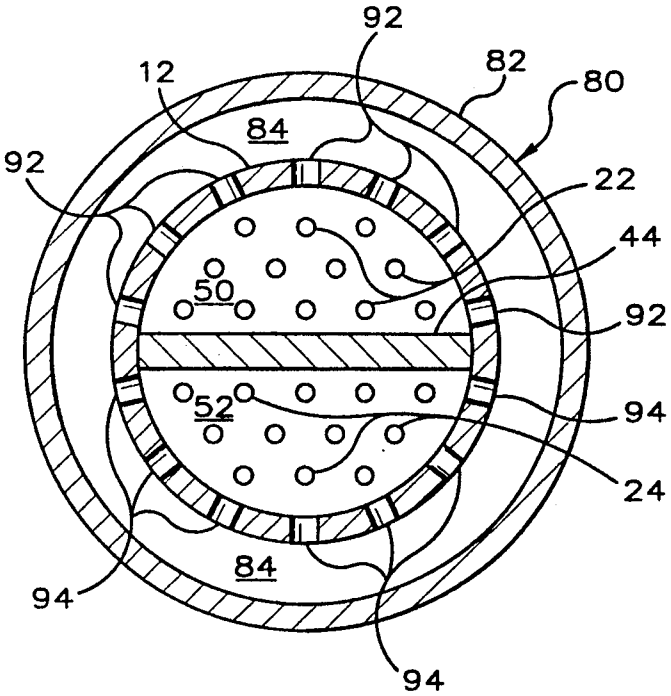
FIG. 3 is an enlarged cross-section view taken along line 3—3 of FIG. 1.

Referring to FIGS. 3 and 4, an annular return distributor is shown and generally designated by the numeral 80. The annular return distributor 80 provides means for providing direct fluid flow communication between the upper chamber 50 and the lower chamber 52 through the exterior of the shell 12. Annular return distributor 80 comprises a return distributor shell 82 which circumscribes a portion of the heat exchanger shell 12 so as to create an annular return chamber 84. The annular return distributor 80 is fixedly secured to the heat exchanger shell 12 so as to circumscribe a portion of the heat exchanger between the annular distributor 54 and the second end 16 of the shell 12. Preferably, the annular return distributor 80 is positioned so as to circumscribe a portion of the longitudinal baffle 44 in close proximity to the second end 48 of the longitudinal baffle 44.

The heat exchanger shell 12 is provided with at least one second upper slot-like opening or port 92 that provides direct fluid flow communication between the upper chamber 50 and the annular return chamber 84. Preferably, the heat exchanger shell 12 is provided with a plurality of second upper slot-like openings 92, wherein each second upper slot-like opening 92 provides direct fluid flow communication between the upper chamber 50 and the annular return chamber 84.

The heat exchanger shell 12 is provided with at least one second lower slot-like opening or port 94 that provides direct fluid flow communication between the lower chamber 52 and the annular return chamber 84. Preferably, the heat exchanger shell 12 is provided with a plurality of second lower slot-like openings 94 wherein each second lower slot-like opening 94 provides direct fluid flow communication between the lower chamber 52 and the annular return chamber 84. In the method of this invention, fluid within the upper chamber 50 passes through the second upper slot-like openings 92 into the annular return chamber 84. The fluid then passes from the annular return chamber 84 through the second lower slot-like openings 94 into the lower chamber 52. Thereby, direct fluid flow communication is provided between the upper chamber 50 and the lower chamber 52 without the need for fluid to pass through the flow obstructed opening between the second end 48 of the longitudinal baffle 44 and the second end 16 of the shell 12. By eliminating the necessity for fluid flow through this flow obstructed opening within the shell 12, excessive flow obstructions and associated pressure losses are eliminated.

It is apparent to those skilled in the art that heat exchangers designed in accordance with the invention can be designed incorporating a variety of multiple tube pass configurations known in the art in addition to the U-tube configuration described, such as floating head designs, fixed tube sheet designs, etc.

From the foregoing detailed description, it will be seen that the apparatus described and illustrated herein eminently achieve the objects of the present invention. Changes may be made in the combination and arrangement of parts or elements as heretofore set forth in the specification and shown in the drawings without departing from the spirit and scope of the invention as defined in an limited only by the following claims.

That which is claimed is:

1. A shell unit for use in a two pass shell and tube heat exchanger, comprising:

a shell having a first end and a second end and an interior and an exterior and having at least one first shell opening between said first end and said second end and at least one second shell opening between said first end and said second end and wherein said at least one second shell opening is completely separate and distinct from said at least one first shell opening;

a longitudinal baffle sealingly engaged to the interior of said shell, wherein said longitudinal baffle divides at least a portion of the interior of said shell into a top half and a bottom half wherein said first shell openings are in communication with said top half and said second shell openings are in communication with said bottom half; and return distributor means for providing direct fluid flow communication between said at least one first shell opening and said at least one second shell opening through said exterior of said shell.

2. A shell unit in accordance with claim 1 having a plurality of said first shell openings in communication with said top half and a plurality of said second shell openings in communication with said bottom half.

3. A shell unit in accordance with claim 1, wherein said return distributor means comprises at least one cylindrical surface concentrically surrounding at least a portion of said shell, thus forming an annulus between said shell and said cylindrical surface and having closing members at each end of said annulus wherein said annulus is in direct fluid flow communication with said first shell openings and said second shell openings.

4. A shell unit in accordance with claim 3, wherein said longitudinal baffle has a first end in contact with said first end of said shell and a second end positioned between said first end and said second end of said shell, wherein return distributor means circumscribes at least a portion of said longitudinal baffle.

5. A shell unit in accordance with claim 4, wherein at least a portion of return distributor means circumscribes said second end of said longitudinal baffle.

6. A shell and tube heat exchanger comprising:

a shell having a first end and a second end and an interior and an exterior and having at least one first shell opening between said first end and said second end and at least one second shell opening between said first end and said second end and wherein said at least one second shell opening is completely separate and distinct from said at least one first shell opening;

a longitudinal baffle sealingly engaged to the interior of said shell, wherein said longitudinal baffle divides at least a portion of the interior of said shell into a top half and bottom half wherein said at least one first shell opening are in communication with said top half and said at least one second shell opening are in communication with said bottom half;

a tube sheet disposed transversely within said shell wherein said tube sheet is in contact with said longitudinal baffle and wherein said longitudinal baffle divides said tube sheet into a top half and bottom half;

a plurality of U-shaped tubes having a first end, a U-bend region and a second end wherein said first end of each said U-shaped tube pierces said top half of said tube sheet and wherein said second end of each said U-shaped tube pierces said bottom half of said tube sheet; and return distributor means for providing direct fluid flow communication between said first shell openings and said second shell openings through said exterior of said shell.

7. A shell and tube heat exchanger in accordance with claim 6 having a plurality of said first shell openings in communication with said top half and a plurality of said second shell openings in communication with said bottom half.

8. A shell and tube heat exchanger in accordance with claim 6, wherein said return distributor means comprises at least cylindrical surface concentrically surrounding at least a portion of said shell, thus forming an annulus between said shell and said cylindrical surface and having closing members at each end of said annulus wherein said annulus is in direct fluid flow communication with said first shell openings and said second shell openings.

9. A shell and tube heat exchanger in accordance with claim 8, wherein said longitudinal baffle has a first end in contact with said first end of said shell and a second end positioned between said first end and said second end of said shell, wherein return distributor means circumscribes at least a portion of said longitudinal baffle.

10. A shell and tube heat exchanger in accordance with claim 9, wherein at least a portion of return distributor means circumscribes said second end of said longitudinal baffle.

* * * * *